US010724223B2

(12) United States Patent
Seki et al.

(10) Patent No.: US 10,724,223 B2
(45) Date of Patent: Jul. 28, 2020

(54) URINAL

(71) Applicant: TOTO LTD., Kitakyushu-shi, Fukuoka (JP)

(72) Inventors: Yoshifumi Seki, Kitakyushu (JP); Satoshi Matsunaka, Kitakyushu (JP); Hironori Yamasaki, Kitakyushu (JP); Masaki Miura, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 148 days.

(21) Appl. No.: 14/849,947

(22) Filed: Sep. 10, 2015

(65) Prior Publication Data

US 2016/0069060 A1 Mar. 10, 2016

(30) Foreign Application Priority Data

Sep. 10, 2014 (JP) ..... 2014-183958

(51) Int. Cl.
*E03D 13/00* (2006.01)

(52) U.S. Cl.
CPC ..... *E03D 13/005* (2013.01)

(58) Field of Classification Search
CPC ..... E03D 13/005
USPC ..... 4/310, 301, 114.1, 144.1
See application file for complete search history.

(56) References Cited

U.S. PATENT DOCUMENTS 5,305,473 A * 4/1994 Nakamura ..... E03D 13/00 4/306
6,675,399 B1 1/2004 Tomita et al.
2003/0140406 A1 7/2003 Miwa et al.
2004/0181861 A1 9/2004 Inglin et al.

FOREIGN PATENT DOCUMENTS

DE 102012110856 5/2013
JP 6060684 U 8/1994
JP H0660684 8/1994
JP 2501480 6/1996
JP 2001123515 5/2001
JP 2002106049 A 4/2002
(Continued)

OTHER PUBLICATIONS

Japanese Decision to Grant a Patent for Japanese Application No. JP 2014-183958, English Translation attached to original, Date of Drafting from Japanese Patent Office Feb. 25, 2016, All together 6 Pages.

(Continued)

*Primary Examiner* — Christine J Skubinna
(74) *Attorney, Agent, or Firm* — Broooks Kushman P.C.

(57) ABSTRACT

A urinal capable of suppressing the flow speed differential between the flow speed of flush water flowing into the front side of an ascending pipe and the flow speed of flush water flowing into the back side thereof, and of suppressing the occurrence of stagnation in the flow of flush water, and of suppressing the occurrence of uric scale. The urinal having a discharge trap including a horizontal pipe; a top portion of horizontal pipe is formed by a return flow path-forming portion at the bottom end of the shared wall; and a resistance portion for slowing the flow speed of flush water flowing in the vicinity of this bottom portion is formed at the bottom portion of the horizontal pipe.

12 Claims, 7 Drawing Sheets

(56) References Cited

FOREIGN PATENT DOCUMENTS

| | | | |
|---|---|---|---|
| JP | 2003301504 | A | 10/2003 |
| JP | 2004162404 | A | 6/2004 |
| JP | 2012149415 | | 8/2012 |
| JP | 2013014964 | A | 1/2013 |

OTHER PUBLICATIONS

Chinese Office Action for Chinese Application No. CN 201510570283.8, Completed by the Chinese Patent Office, dated Nov. 17, 2016, 6 Pages.

* cited by examiner

URINAL

CROSS-REFERENCE TO RELATED APPLICATIONS

This application claims priority to JP application JP 2014-183958 filed on Sep. 10, 2014, the disclosure of which is incorporated in its entirety by reference herein.

TECHNICAL FIELD

The present invention pertains to a urinal, and more particularly to a urinal in which the bowl portion is flushed with flush water.

BACKGROUND

Urinals comprising a discharge trap formed at the bottom of a bowl portion for receiving a user's urine have been known for some time, as shown in Patent Document 1 (Japanese Published Unexamined Patent Application 2013-14965), Patent Document 2 (Japanese Published Unexamined Patent Application 2013-14964), and Patent Document 3 (Japanese Published Unexamined Patent Application 2011-214262). Such conventional discharge traps form a U shape having a descending pipe extending downward, a horizontal pipe gradually curving from the descending pipe and extending horizontally, and an ascending pipe similarly gradually curving from the horizontal pipe and extending upward.

To prevent the penetration of foul smells, etc. from discharge plumbing into the toilet space, a predetermined amount of flush water is constantly accumulated as pooled water at the bottom portion of the discharge trap; a water seal is formed by this pooled water.

When a user uses the urinal to urinate, urine flows into the discharge trap; the majority of the pooled water is discharged by the inflow of urine, and inside the discharge trap a liquid with a high urine concentration mixture of urine and water is present as pooled water. When flush water is flowed into the bowl portion after urination in order to flush the bowl portion after usage by a user, that flush water newly flows into the discharge trap; a liquid with a high urine concentration mixture of urine and water is discharged from the discharge trap, and is substituted by this newly inflowing flush water.

In the discharge trap, when the rate of substitution at which pooled water comprising a high urine concentration liquid is replaced by newly inflowing flush water (or the dilution rate at which pooled water comprising a high urine concentration liquid is diluted by newly inflowing flush water) is low, the urine concentration in post-replacement pooled water is high, and uric scale is known to more easily occur within the discharge trap. Note that the substitution rate is calculated based on how much of the urine-mixed fluid which had been accumulating in the trap prior to flushing is replaced by flush water.

SUMMARY

Technical Problem

In recent years, influenced by the increase in environmental awareness, there has been a requirement to reduce the amount of flush water used to flush the bowl portion.

However, when attempting to reduce flush water amounts, the reduction in flush water amount used to substitute pooled water formed of a high urine-concentration liquid tends to reduce the pooled water substitution rate, such that urine concentration in the post-substitution pooled water is increased, leading to the problem that uric scale can easily form within the discharge trap.

Therefore the issue arises that the substitution rate must be raised so pooled water made up of high urine-concentration liquid can be substituted using a relatively small amount of flush water.

Also, when the flush water amount is reduced, then in cases where an effort is made to compactify the discharge trap so that a water seal can be formed with a small pooled water amount, sharp bends from the discharge trap descending pipe to the horizontal pipe and from the horizontal pipe to the ascending pipe are formed, leading to a tendency to increase the flush water flow speed differential between the horizontal pipe upper side (inside the bend) and the bottom portion side (outside the bend). This increase in flow speed differential causes stagnation in the flow of flush water in the ascending pipe downstream of the horizontal pipe, causing the problem of a reduced pooled water substitution rate.

When the amount of flush water is reduced, in cases where an effort is made to form the discharge trap compactly to enable the formation of a water seal with a small amount of pooled water, the discharge trap is filled with a small amount of water, therefore following urination by a user the discharge trap is essentially filled with the user's urine, and the pooled water comprises an extremely high urine concentration liquid. Therefore the issue also arises that the substitution rate must be raised so pooled water made up of extremely high urine-concentration liquid can be substituted by a relatively small amount of flush water.

This invention was therefore undertaken to resolve deficiencies in the conventional art; it is capable of suppressing the difference in the flow speed between flush water flowing on the top side of the horizontal pipe and the flow speed of flush water flowing at the bottom side of the horizontal pipe, and of suppressing the flow speed difference between flush water respectively flowing into the front side and back side of the ascending pipe, and of suppressing the occurrence of stagnation of flush water flow in the ascending pipe. The object is to thus provide a urinal whereby the substitution rate for pooled water into which urine is mixed in the discharge trap can be improved, and residual urine in the post-flush pooled water can be reduced, thereby reducing the occurrence of uric scale.

Solution to Problem

In order to achieve the above object, the present invention is a urinal in which a bowl portion is flushed with flush water, having: a bowl portion on the bottom portion of which a discharge opening is provided, a discharge trap into which flush water which has passed through the discharge opening flows, for accumulating flush water and forming a water seal, and a connecting portion for connecting the discharge trap with discharge plumbing for discharging water connected on the downstream side of this discharge trap; and the discharge trap comprises a descending pipe extending downward from the discharge opening, and an upward extending ascending pipe; the descending pipe rear wall and ascending pipe front wall are formed by a shared wall, and the discharge trap further comprises a horizontal pipe connecting the downstream end of the descending pipe to the upstream end of the ascending pipe; the top portion of this horizontal pipe is formed by a return flow path-forming portion at the bottom end of the shared wall, and a resistance portion for reducing the flow speed of flush water flowing in the vicinity of this bottom portion is formed at the bottom portion of the horizontal pipe.

In the invention thus constituted the top portion of the horizontal pipe is formed by the return flow path-forming portion at the bottom end of the shared wall, and a resistance portion for reducing the flow speed of flush water flowing in the vicinity of the bottom portion is formed at the bottom portion of the horizontal pipe, therefore the flow speed of flush water flowing in the vicinity of the bottom portion is slowed by the resistance portion. As a result, a reduction can be achieved in the differential between the flow rate of flush water flowing in the vicinity of the return flow path-forming portion at the top portion of the horizontal pipe, and in the flow rate of flush water flowing in the vicinity of the bottom portion on the bottom portion side of the horizontal pipe. Therefore in the ascending pipe connected to the downstream side of the horizontal pipe, the difference can be suppressed between the flow speed of flush water flowing into primarily the front side of the ascending pipe from the vicinity of the return flow path-forming portion, and the flow speed of flush water flowing into primarily the rear side of the ascending pipe from the vicinity of the bottom portion of the horizontal pipe. Therefore flow speed differentials in flush water flowing into the ascending pipe can be suppressed, as can the occurrence of stagnated flush water flow in the ascending pipe. By so doing, the substitution rate for pooled water into which urine is mixed in the discharge trap can be improved, and residual urine in the post-flush pooled water can be reduced, thereby reducing the occurrence of uric scale.

In the present invention, the resistance portion of the horizontal pipe in the discharge trap is preferably formed further upstream than a position vertically below the return flow path-forming portion at the bottom end of the shared wall.

In the invention thus constituted, the resistance portion is formed starting upstream of a position vertically below the return flow path-forming portion at the bottom end of the shared wall, therefore out of the flush water flowing down the descending pipe, the part primarily flowing into the vicinity of the bottom portion of the horizontal pipe collides with the resistance portion formed at the bottom portion of the horizontal pipe, thereby more easily reducing the flow speed thereof. Therefore the flow rate of flush water flowing near the bottom portion of the horizontal pipe can be further reduced using the resistance portion formed in the bottom portion of the horizontal pipe.

In the present invention the bottom surface of the discharge trap is preferably formed by a first arcuate portion formed on the upstream side of the resistance portion, by the resistance portion, and by a second arcuate portion formed on the downstream side of the resistance portion.

In the invention thus constituted, the discharge trap bottom surface has, in addition to a resistance portion, a first arcuate portion and second arcuate portion for smoothly introducing flush water, therefore the flow speed of flush water flowing in the bottom portion vicinity of the horizontal pipe can be reduced, and flush water can be smoothly flowed into the discharge trap.

In the present invention the resistance portion of the horizontal pipe of the discharge trap is preferably a flat portion in which the bottom portion is formed in a flat section in the front-to-rear cross section of the horizontal pipe.

In the invention thus constituted, the flow speed of flush water flowing in the vicinity of the horizontal pipe bottom portion can be reduced using a flat portion formed in the bottom portion of the horizontal pipe. Therefore through use of a relatively simple structure, flow speed differentials in flush water flowing into the ascending pipe can be suppressed, as can the occurrence of stagnated flow of flush water in the ascending pipe.

In the present invention the resistance portion of the horizontal pipe of the discharge trap is preferably a corrugated portion formed at the bottom portion.

In the invention thus constituted, the flow speed of flush water flowing in the vicinity of the horizontal pipe bottom portion can be reduced using a corrugated portion formed in the bottom portion of the horizontal pipe. Therefore through use of a relatively simple structure, flow speed differentials in flush water flowing into the ascending pipe can be suppressed, as can the occurrence of stagnated flow of flush water in the ascending pipe.

In the present invention the resistance portion of the horizontal pipe of the discharge trap is preferably a projecting portion protruding from the bottom portion.

In the invention thus constituted, the flow speed of flush water flowing in the vicinity of the horizontal pipe bottom portion can be reduced using the projecting portion protruding from the bottom portion of the horizontal pipe. Therefore through use of a relatively simple structure, flow speed differentials in flush water flowing into the ascending pipe can be suppressed, as can the occurrence of stagnated flow of flush water in the ascending pipe.

Advantageous Effects of Invention

Using a urinal according to the present invention, the differential between the flow speed of flush water flowing on the top side of the horizontal pipe and the flow speed of flush water flowing on the bottom side of the horizontal pipe can be suppressed, and the flow speed differential between the flow speed of flush water flowing in on the front side of the ascending pipe and the flow speed of flush water flowing in on the back side thereof can be suppressed, and stagnation of the flow of flush water inside the ascending pipe can be prevented. By so doing, the substitution rate for pooled water into which urine is mixed in the discharge trap can be improved, and residual urine in the post-flush pooled water can be reduced, thereby reducing the occurrence of uric scale.

DETAILED DESCRIPTION

Figure 1:
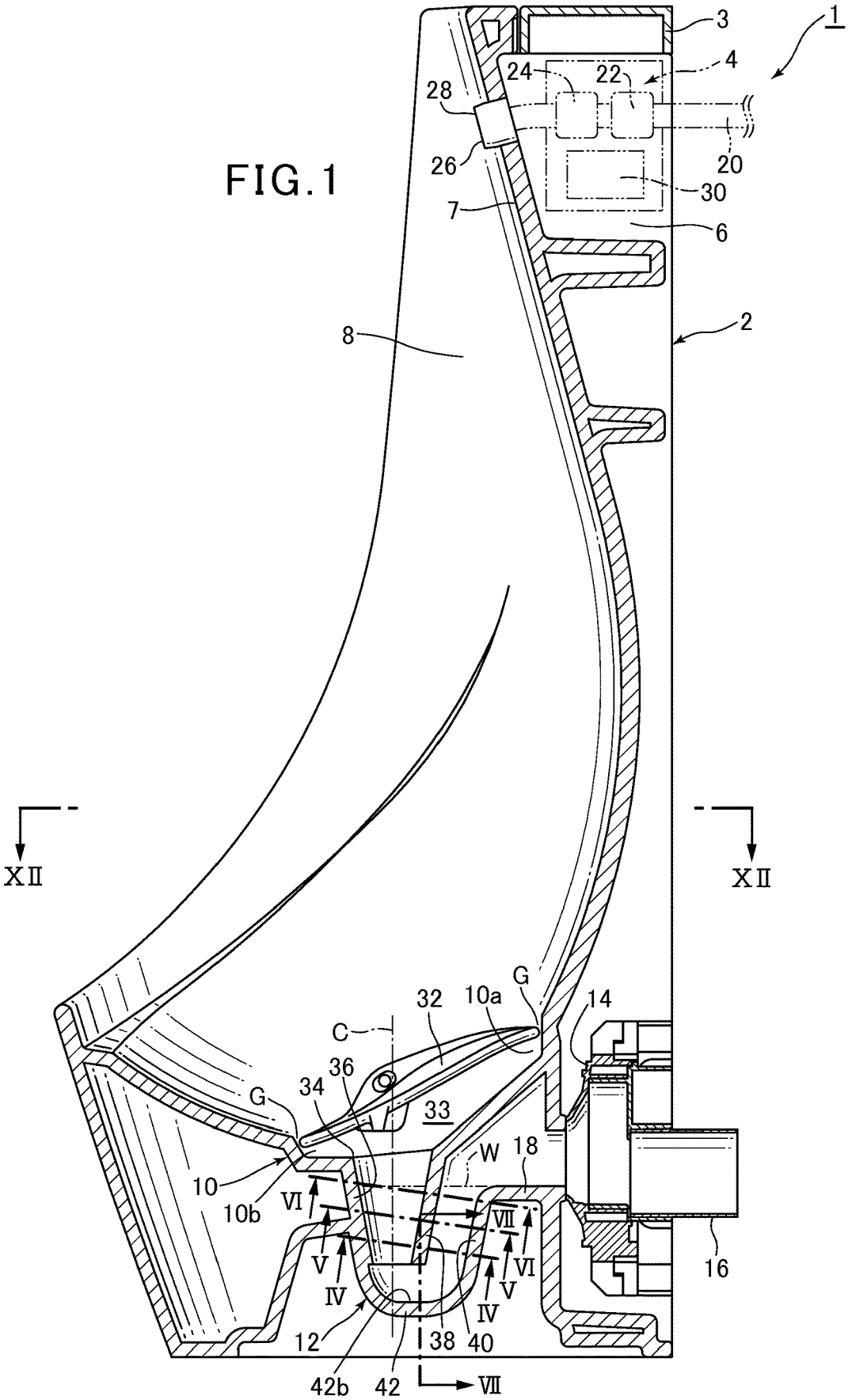
FIG. 1 is a simplified cross section showing a urinal according to an embodiment of the invention.
Figure 2:
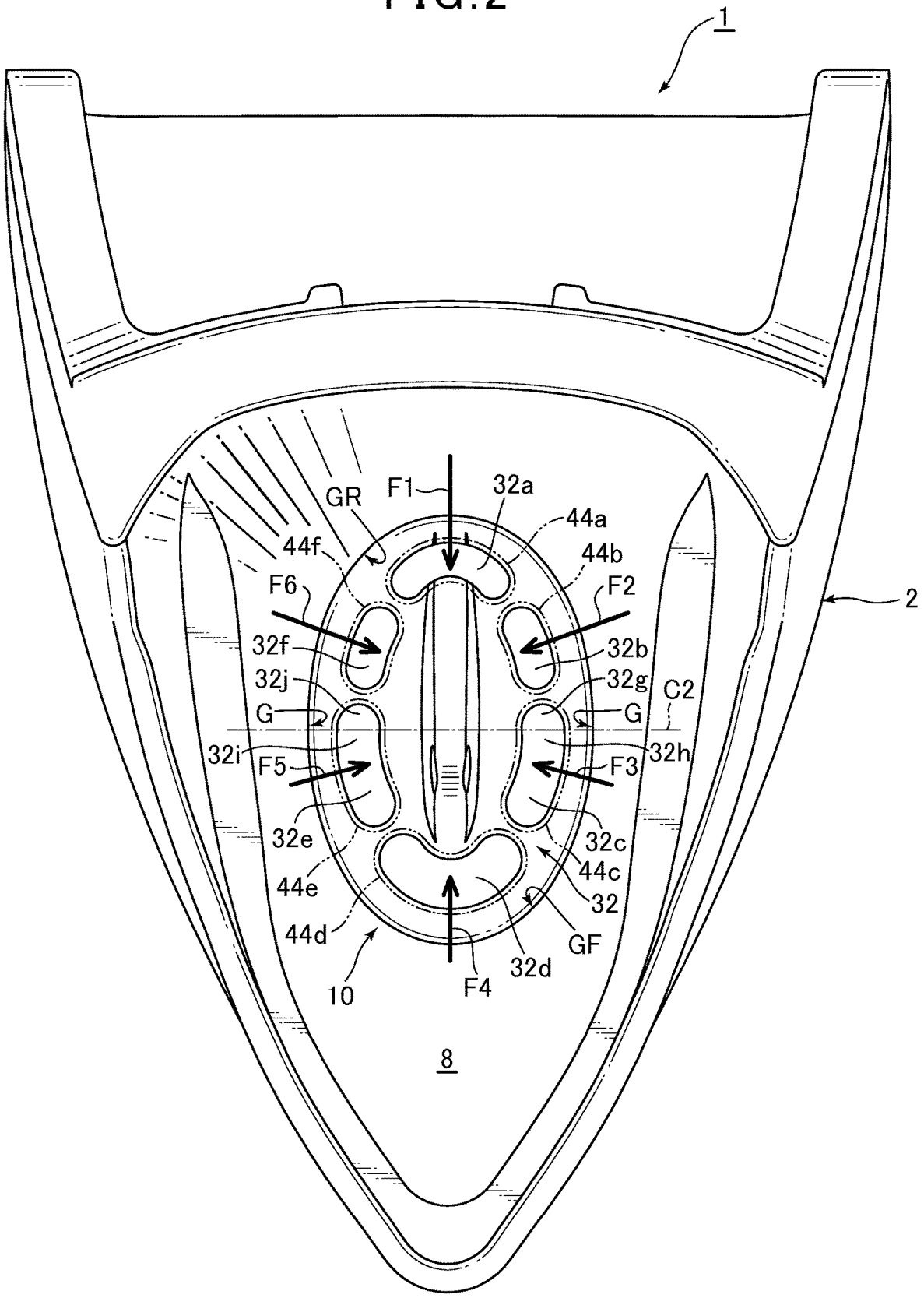
FIG. 2 is a top view showing a urinal according to an embodiment of the invention.
Figure 3:
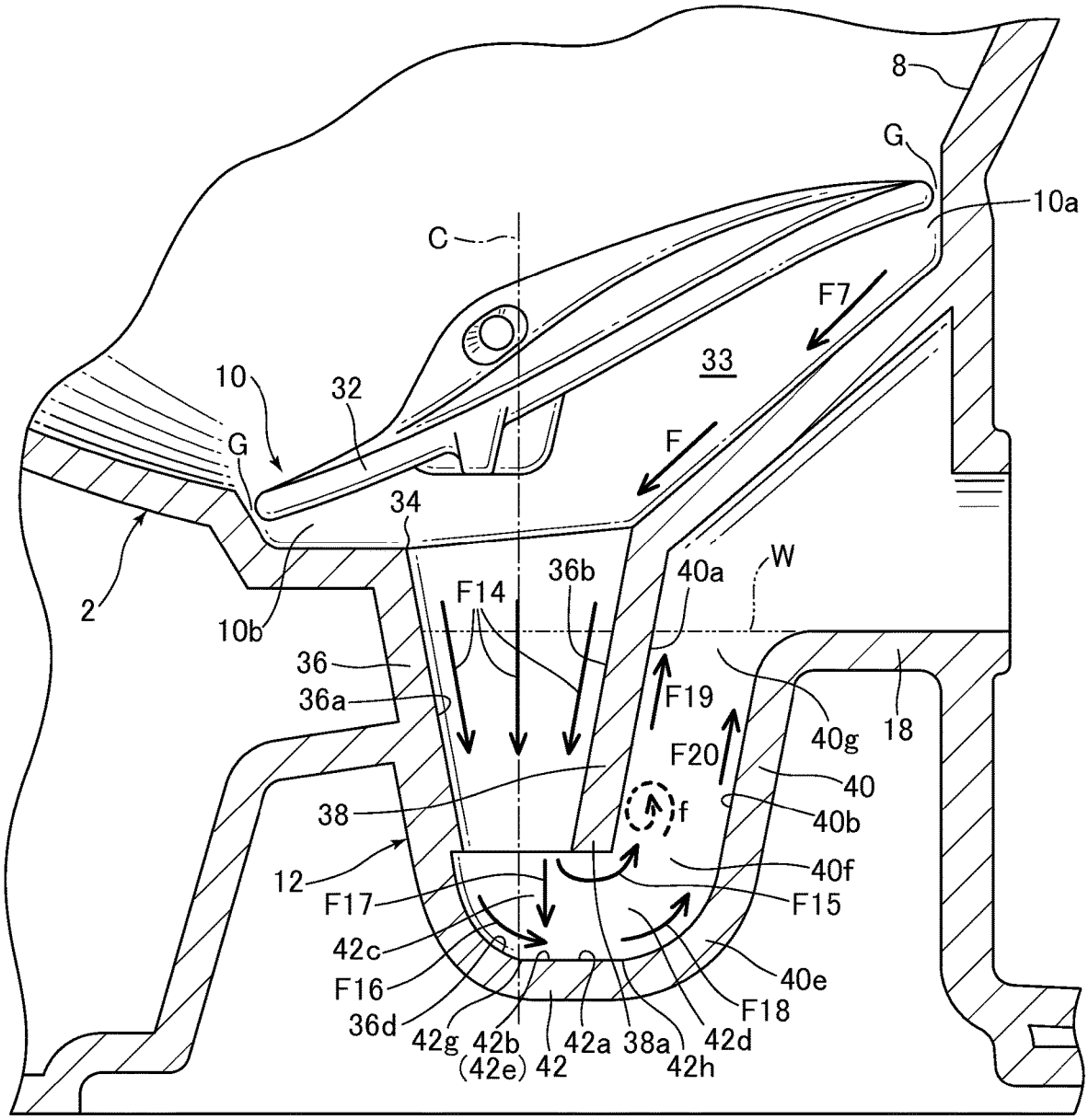
FIG. 3 is an expanded cross section of a portion around the discharge trap of a urinal according to an embodiment of the invention.

Referring to the attached figures, we explain a urinal according to an embodiment of the invention. First, referring to FIGS. 1 through 3, we explain the basic structure of the urinal. FIG. 1 is a simplified cross-section showing a urinal according to an embodiment of the invention; FIG. 2 is a top view showing a urinal according to an embodiment of the invention; FIG. 3 is a partially expanded cross-section of the area around the discharge trap of a urinal according to an embodiment of the invention.

As shown in FIGS. 1 through 3, reference numeral 1 indicates a urinal according to an embodiment of the invention; this urinal 1 comprises a porcelain urinal main unit 2, and an automatic toilet flushing unit 4 for flushing this urinal main unit 2. Urinal 1 is a wall-mounted urinal, attached to the wall behind it so that its own lowermost part is suspended above the floor, but urinal 1 may also be a urinal of the floor-mounted type, directly disposed on the floor surface. Urinal 1 may also be a water saving urinal which flushes with a flush amount of, for example, 0.5 L to 1.0 L when flushing. In the explanation which follows we shall refer to the front elevation side of urinal 1 as the front side, the back elevation side as the rear side (back side), the left side seen from the front elevation of urinal 1 as the left side, and the right side seen from the front elevation of 1 as the right side.

Urinal main unit 2 of urinal 1 comprises a housing room 6 for housing at its upper end the above-described automatic toilet flushing unit 4 (shown in simplified form in FIG. 1 and omitted in other figures), a bowl portion 8 wherein a bowl surface is formed extending downward from the front surface 7 of housing room 6, a discharge opening portion 10 formed at the bottom portion of this bowl portion 8, a discharge trap 12 into which flush water which has passed through discharge opening portion 10 is flowed and pooled water W is accumulated on the downstream side of discharge opening portion 10 to form a water seal, and a connecting portion 18 for connecting discharge socket 14 connected on the downstream side of this discharge trap 12 with water discharge plumbing 16.

Housing room 6 is formed of urinal main unit 2 and cover 3, which is a separate unit. The front surface 7 of housing room 6 is formed to tilt backwards. The automatic toilet flushing unit 4 stored in housing room 6 comprises: a water supply pipe 20 for supplying flush water from a water supply source such as municipal water, a flow regulator 22 disposed on water supply pipe 20, an on/off valve 24 attached to water supply pipe 20 for supplying and stopping the supply of water, a spreader 26, being a water-spouting portion attached to the end of water supply pipe 20, a body sensor 28 for detecting the presence of a user, and a control unit 30 capable of controlling on/off valve 24 and the like based on the detection signal from body sensor 28 and a predetermined control program, etc. Therefore in automatic toilet flushing unit 4, control unit 30 controls on/off valve 24, etc. based on the detection signal from body sensor 28 and a predetermined control program, or the like, causing the spouting of flush water into the bowl portion 8 from spreader 26.

In bowl portion 8, the top surface thereof forms an arcuate surface having a relatively large curvature radius at the top portion thereof in the horizontal direction, and the bottom portion thereof forms an arcuate surface having a relatively small curvature radius. Moreover, the bottom portion thereof is formed in a shape which converges as it curves in a basin shape.

Spreader 26 is formed at a position higher than the center of bowl portion 8 on the left-right center axis line of bowl portion 8. The flow volume of flush water spouted from spreader 26 is set to be essentially fixed per unit time.

A grate 32, described in detail below, is disposed at the entrance opening portion 10*a* on the upstream side of discharge opening portion 10. A discharge opening 34 constituting the entrance opening of discharge trap 12 is formed on the outlet portion 10*b* on the downstream side of discharge opening portion 10.

A connecting portion 18 is disposed on the downstream side of discharge trap 12, and discharge socket 14 is connected to connecting portion 18. Discharge plumbing 16 for discharging water is connected on the downstream side of discharge socket 14. Note that in the present embodiment, discharge socket 14 is connected to connecting portion 18, but it is also possible to omit discharge socket 14 and connect discharge plumbing 16 to connecting portion 18.

Next we explain discharge trap 12 in detail.

As shown in FIG. 3, discharge trap 12 comprises a descending pipe 36 extending downward from the discharge opening 34 on the entrance opening of discharge trap 12, an ascending pipe 40 whose own front wall 40*a* and the descending rear pipe rear wall 36*b* of descending pipe 36 are formed by shared wall 38, and a horizontal pipe 42 extending horizontally, whose own upstream side is connected to descending pipe 36, and whose downstream side is connected to ascending pipe 40. The top portion of horizontal pipe 42 is formed by the return flow path-forming portion 38*a* at the bottom end of shared wall 38, and a resistance portion 42*b* for reducing the flow speed of flush water flowing in the vicinity of side surface suspended portion 42*a* is formed on the bottom portion 42*a* of horizontal pipe 42 on the opposite side of this return flow path-forming portion 38*a*.

In discharge trap 12, a shared wall return trap is formed by descending pipe (descending pipe type channel) 36, horizontal pipe (horizontal pipe type channel) 42, and ascending pipe (ascending pipe type channel) 40. In particular, the ascending pipe 40 front wall 40*a* and the descending pipe 36 descending rear pipe rear wall 36*b* are formed by shared wall 38, therefore the downward flow of flush water inside descending pipe 36 changes direction so as to make nearly a half revolution about return flow path-forming portion 38*a* at the bottom end of shared wall 38 as it passes through horizontal pipe 42, forming a rising flow in ascending pipe 40. I.e., the discharge trap 12 in the embodiment is formed so that, due to the down flow in descending pipe 36, flush water changes direction by suddenly reversing as it passes through horizontal pipe 42, changing the direction of its flow by approximately 180° to move upward inside ascending pipe 40, which is formed on the reverse side (rear side) sandwiching shared wall 38.

Thus discharge trap 12 is formed by the shared wall 38 shared between ascending pipe front wall 40*a* and descending rear pipe rear wall 36*b*, so that the size of discharge trap 12 can be made compact, and the amount of pooled water W accumulated in discharge trap 12 can be relatively reduced compared to the past.

Also, a glaze is applied to the inside wall surface of discharge trap 12. The glaze is a vitreous coating layer, primarily composed of inorganic material; the glaze is sprayed on to the porcelain ground surface and formed by firing.

The application of such a glaze layer results in a greater surface smoothness compared to using a base only. Therefore compared to a composition of a base material only, it is more difficult for bacteria to accumulate on the inside wall surface of discharge trap 12, and the occurrence of dirt or uric scale caused by bacteria can be suppressed.

The discharge trap 12 descending pipe 36 is formed of descending pipe front wall 36*a* and shared wall 38, which forms descending rear pipe rear wall 36*b* at the rear side of descending pipe 36. Descending pipe front wall 36*a* on descending pipe 36 and shared wall 38 are formed to be symmetrical about the center axis line C of descending pipe 36, and in such a way that the downstream side thereof is narrowed. The meaning of the term "symmetrical" includes the state of being essentially symmetrical, within some range (same below). In addition, descending pipe 36 is also formed to be symmetrical relative to center axis line C in the left-right direction.

Discharge trap 12 horizontal pipe 42 is formed to extend laterally from the bottom end of descending pipe 36, and to extend essentially horizontally from side wall portion 42*c* to horizontal pipe exit 42*d* in the front-to-back direction; that horizontal pipe entrance 42*c* is connected to the exit-side arcuate portion 36*d* on descending pipe 36, and the horizontal pipe exit 42*d* thereof is connected to the entrance-side arcuate portion 40*e* on the entry side of the upstream side portion of ascending pipe 40. Exit-side arcuate portion 36*d* enables the smooth introduction of descending flush water to horizontal pipe 42. Also, in entrance-side arcuate portion 40*e*, flush water which has passed through horizontal pipe 42 is smoothly introduced to ascending pipe 40.

In return flow path-forming portion 38*a* and bottom portion 42*a* of horizontal pipe 42, horizontal pipe 42 has a flat portion 42*e* extending flat in the front-to-back direction; this flat portion 42*e* constitutes a resistance portion 42*b* with which the flush water flow collides, thereby enabling flow speed to be suppressed. The meaning of the term "flat" includes the state of being essentially flat with some degree of displacement (same below). In the present embodiment this flat portion 42*e* is formed from the horizontal pipe entrance 42*c* to the horizontal pipe exit 42*d* of horizontal pipe 42. More concretely, the starting point of flat portion 42*e* is shown by 42*g*, and the end point thereof as 42*h*. Note that exit-side arcuate portion 36*d*, flat portion 42*e*, and entrance-side arcuate portion 40*e* form the bottom surface on the bottom side of discharge trap 12.

As shown in FIG. 3, in the front-to-back central cross section of horizontal pipe 42, this flat portion 42*e* is formed to extend in a straight line in essentially a horizontal direction, front-to-back. Even in positions where the front-to-back cross section of horizontal pipe 42 is offset to the left or right of the horizontal pipe center, flat portion 42*e* is similarly formed to extend in essentially a horizontal direction, front-to-back.

Note that for the front-to-back and left-to-right directions, respectively, flat portion 42*e* may also be formed as a relatively flat part, formed using a relatively large curvature radius R.

Figure 7:
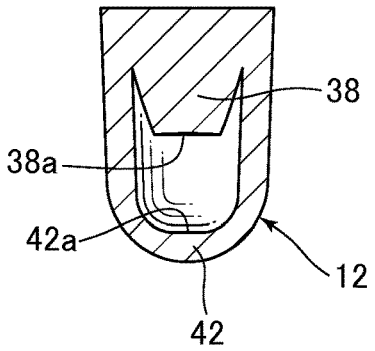
FIG. 7 is a cross section seen along line VII-VII in FIG. 1.

Moreover, as shown in FIG. 7, in the left-to-right direction cross section of horizontal pipe 42 near return flow path-forming portion 38*a*, this flat portion 42*e* is formed so that bottom portion 42*a* extends in essentially a horizontal direction in a straight line over the left-to-right direction. Also, in the left-to-right cross section of horizontal pipe 42 on at least the front side of return flow path-forming portion 38*a*, this flat portion 42*e* is formed so that bottom portion 42*a* extends in essentially a horizontal direction in a straight line over the left-to-right direction, and similarly in the front-to-back direction.

This flat portion 42*e* is formed further upstream than a position vertically below return flow path-forming portion 38*a* at the bottom end of shared wall 38. I.e., upstream end 42*g* of flat portion 42*e* is positioned further upstream (on the lower side of descending pipe 36) than a position vertically below return flow path-forming portion 38*a*.

In other words, when viewed from directly above descending pipe 36, flat portion 42*e* is disposed so that at least a part of flat portion 42*e* can be seen in a position vertically below the exit of descending pipe 36. Therefore a portion of the flush water flowing down from descending pipe 36 collides with at least a portion of flat portion 42*e*.

Figure 8:
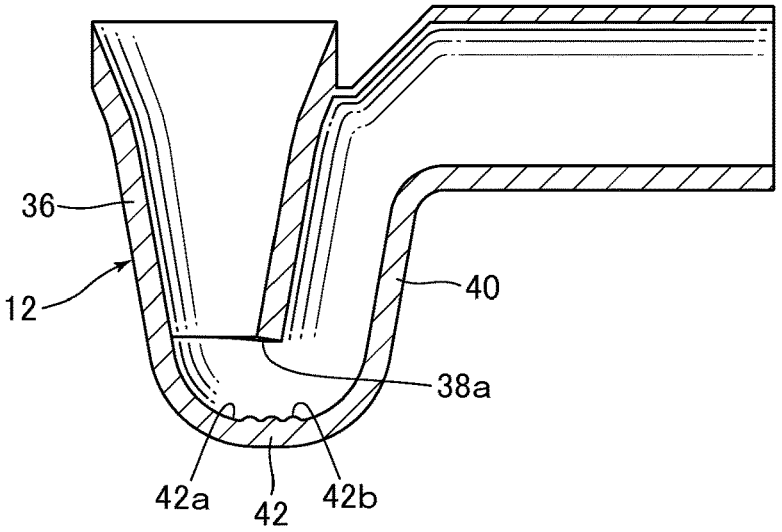
FIG. 8 is a simplified cross section showing a variant example of the discharge trap horizontal pipe in a urinal according to an embodiment of the invention.
Figure 9:
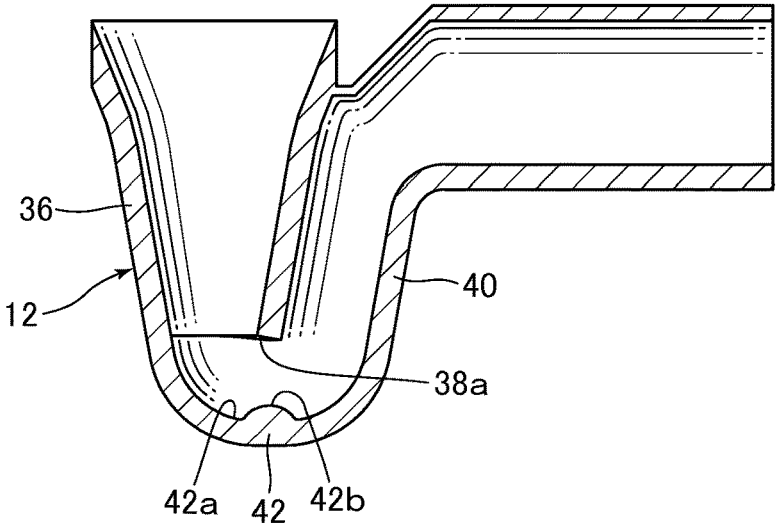
FIG. 9 is a simplified cross section showing a variant example of the discharge trap horizontal pipe in a urinal according to an embodiment of the invention.

Note that as a variant example, as shown in FIG. 8, discharge trap 12 horizontal pipe 42 resistance portion 42*b* may be formed so that at least a portion of bottom portion 42*a* is formed as a corrugation instead or in addition to the above-described flat portion. Also, as a further variant example, as shown in FIG. 9, discharge trap 12 horizontal pipe 42 resistance portion 42*b* may be formed so that at least a portion of bottom portion 42*a* is formed as a raised projecting portion, instead or in addition to the above-described flat portion. As still another variant example, it is also acceptable for a protuberance, raised in a hill shape, to be formed in at least part at the bottom portion, and for a rib-shaped projecting portion to be formed in bottom portion 42*a*. This type of horizontal pipe 42 resistance portion 42*b* is formed from further upstream position than a position vertically below return flow path-forming portion 38*a* at the bottom end of shared wall 38.

The discharge trap 12 ascending pipe 40 extends upward from the downstream end of horizontal pipe 42. This ascending pipe 40 comprises: a shared wall 38 forming ascending pipe front wall 40*a* on the front side of ascending pipe 40, ascending pipe rear wall 40*b* on the rear side of ascending pipe 40, ascending pipe left side wall 40*c* on the left side of ascending pipe 40, and ascending pipe right side wall 40*d* on the right side of ascending pipe 40.

In ascending pipe 40, the shared wall 38 and ascending pipe rear wall 40*b* form parallel wall surfaces in the front-to-back direction, and are also formed at the same angle of inclination. The term "parallel" includes essentially parallel, including some degree of manufacturing error and the like (same below). The term "same inclination" includes essentially of the same inclination, including some degree of manufacturing error and the like (same below). Therefore the distance between shared wall 38 and ascending pipe rear wall 40*b* is formed to be fixed from the entrance to the exit of ascending pipe 40. The term "fixed" includes essentially fixed, including some degree of manufacturing error and the like (same below).

Ascending pipe 40 is formed so that ascending pipe left side wall 40*c* and ascending pipe right side wall 40*d* formed to its left and right are parallel. These ascending pipe left side wall 40*c* and ascending pipe right side wall 40*d* form an essentially vertically standing plumb wall.

Figure 4:
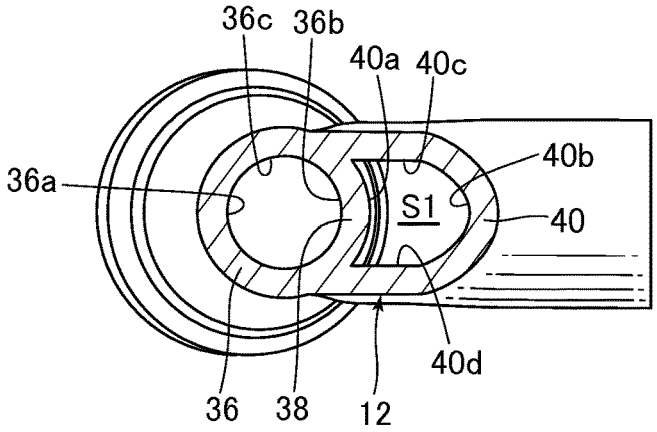
FIG. 4 is a cross section seen along line IV-IV in FIG. 1.
Figure 5:
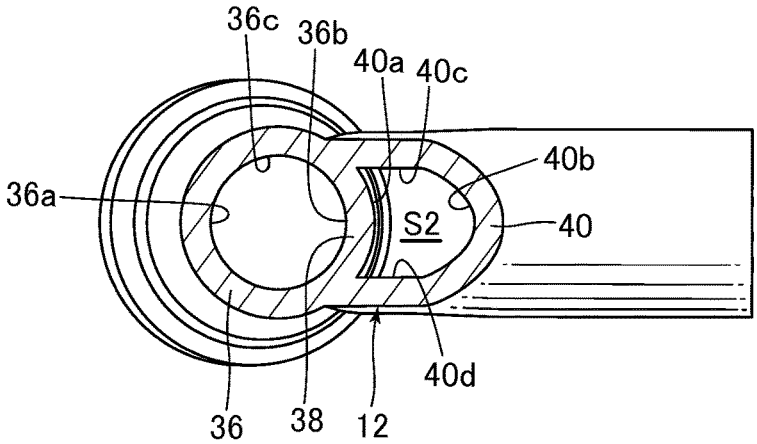
FIG. 5 is a cross section seen along line V-V in FIG. 1.
Figure 6:
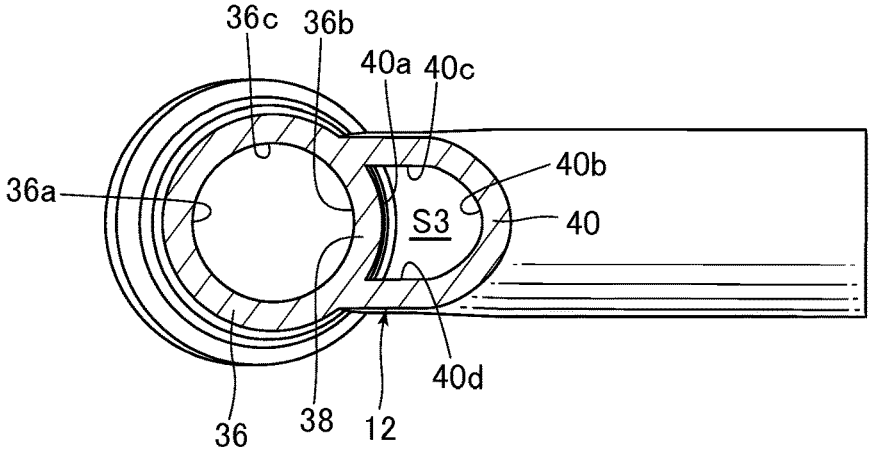
FIG. 6 is a cross section seen along line VI-VI in FIG. 1.

As shown in FIGS. 4 through 6, discharge trap 12 ascending pipe 40 is formed so that the cross sectional surface area S1 of the section IV-IV seen along line IV-IV in FIG. 1, the cross sectional surface area S2 of the section V-V seen along line V-V in FIG. 1, and the cross sectional surface area S3 of the section VI-VI seen along line VI-VI in FIG. 1 are essentially equal.

Thus discharge trap 12 ascending pipe 40 is formed so that its cross sectional area is fixed from the entrance portion 40*f* of ascending pipe 40 to the exit portion 40*g* thereof. More precisely, ascending pipe 40 is formed so that the straight line flow path cross sectional surface area on the downstream side of entrance-side arcuate portion 40*e* is fixed from entrance portion 40*f* to exit portion 40*g*.

Figure 10:
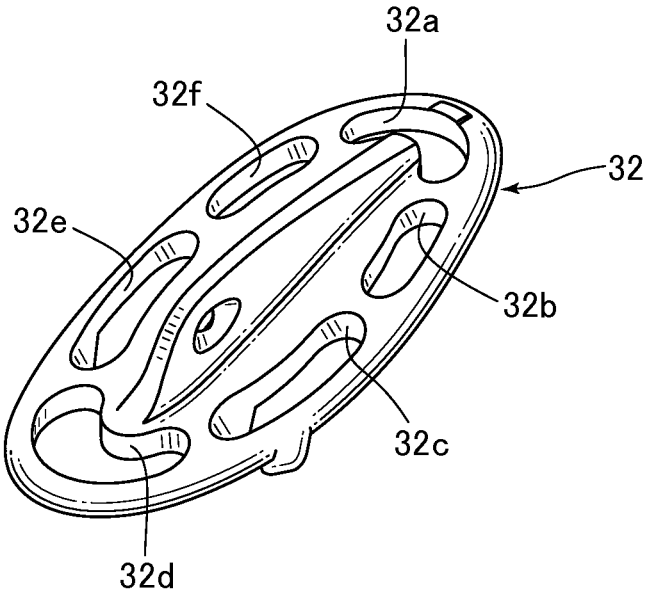
FIG. 10 is a perspective view showing the grate in a urinal according to an embodiment of the invention.
Figure 11:
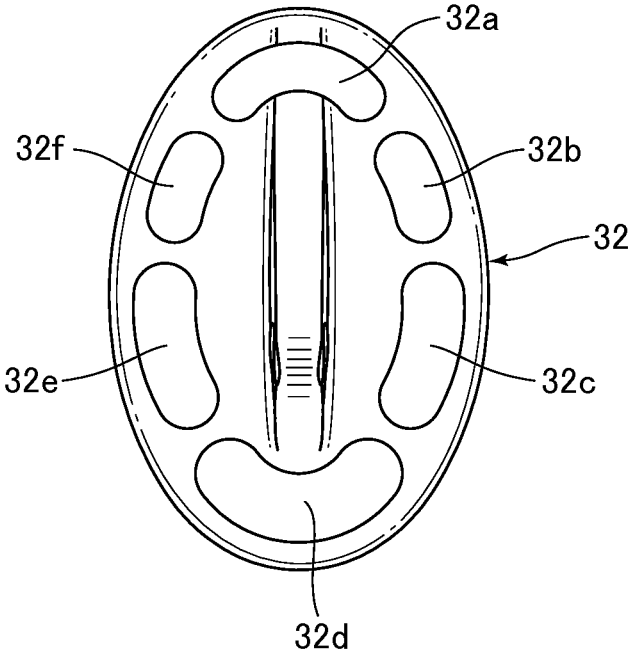
FIG. 11 is a top view showing the grate in a urinal according to an embodiment of the invention.
Figure 12:
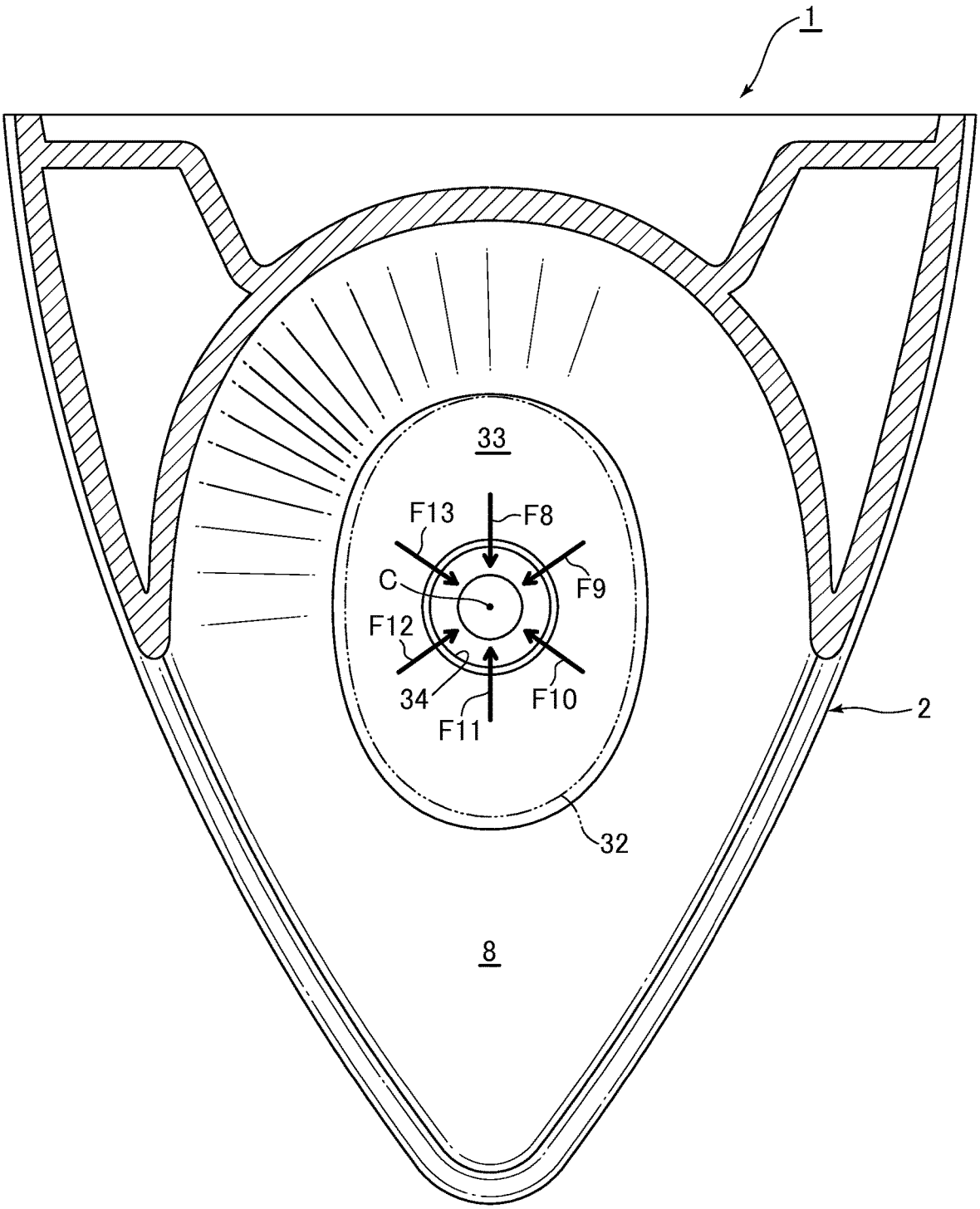
FIG. 12 is a diagram showing the flow of flush water flowing into a discharge opening, with the dotted lines showing an abbreviated grate, in a cross section seen along line XII-XII of FIG. 1.

Next we explain grate 32, as shown in FIGS. 10 through 12.

FIG. 10 is a perspective view showing a urinal grate according to an embodiment of the invention; FIG. 11 is a top plan view showing a urinal grate according to an embodiment of the invention; FIG. 12 is a chart showing the flow of flush water flowing into the discharge opening, with the grate shown in simplified form by dotted lines in a cross section seen along line XII-XII in FIG. 1.

Grate 32 is placed so as to cover the upstream side of discharge opening 34 at the entrance to discharge trap 12 in the bottom portion of bowl portion 8.

Grate 32, as shown in FIG. 11, is formed in an oval shape as seen in top plan, and in a planar shape seen from the side. Grate 32 is formed of resin, porcelain, or the like. At the bottom portion of bowl portion 8, this grate 32 is disposed so that its own outside perimeter curve follows the curved surface of the bowl-shaped bowl portion 8. Grate 32 is disposed on a part formed to sink down from the bowl portion 8 on entrance opening portion 10*a* of discharge opening portion 10, forming a flow surface which is essentially continuous with the curved surface from the top portion of bowl portion 8.

Grate 32 is disposed to cover the top of discharge opening 34 at an angle, and its own center of gravity is disposed at an offset from center axis line C of descending pipe 36. Therefore grate 32 is disposed to cover an area which is asymmetrical relative to the entrance to descending pipe 36 and to the center axis line C of descending pipe 36. In the space between grate 32 and bowl portion 8, the flow path surface area of the flow path connecting the upstream side and downstream side of grate 32 is determined by grate 32.

As shown in FIG. 11, multiple inflow holes constituting a portion of the flow path surface area are formed in the top surface of grate 32. For example, these inflow holes are formed by first inflow hole 32*a*, second inflow hole 32*b*, third inflow hole 32*c*, fourth inflow hole 32*d*, fifth inflow hole 32*e*, and sixth inflow hole 32*f*. First inflow hole 32*a*, second inflow hole 32*b*, third inflow hole 32*c*, fourth inflow hole 32*d*, fifth inflow hole 32*e*, and sixth inflow hole 32*f* are formed so as to penetrate from the front surface through to the reverse surface of grate 32. The number of inflow holes, shape of each inflow hole, diameter of each inflow hole, and size (opening surface area) of each inflow hole can be changed. For example, four inflow holes or eight inflow holes may be formed on the top surface of grate 32.

First inflow hole 32*a* is formed so that flush water flowing into first inflow hole connecting area 44*a*, which is the area around the entrance from bowl portion 8 into first inflow hole 32*a*, can pass from first inflow hole connecting area 44*a* through first inflow hole 32*a* and down into the reverse side area (lower area) 33 of grate 32.

Second inflow hole 32*b* is formed so that flush water flowing into second inflow hole connecting area 44*b*, which is the area around the entrance from bowl portion 8 into first inflow hole 32*b*, can pass from second inflow hole connecting area 44*b* through second inflow hole 32*b* and down into the reverse side area (lower area) 33 of grate 32. Second inflow hole 32*c* is formed so that flush water flowing into third inflow hole connecting area 44*c*, which is the area around the entrance from bowl portion 8 into third inflow hole 32*c*, can pass from third inflow hole connecting area 44*c* through third inflow hole 32*c* and down into the reverse side area (lower area) 33 of grate 32. Fourth inflow hole 32*d* is formed so that flush water flowing into fourth inflow hole connecting area 44*d*, which is the area around the entrance from bowl portion 8 into fourth inflow hole 32*d*, can pass from fourth inflow hole connecting area 44*d* through fourth inflow hole 32*d* and down into the reverse side area (lower area) 33 of grate 32. Fifth inflow hole 32*e* is formed so that flush water flowing into fifth inflow hole connecting area 44*e*, which is the area around the entrance from bowl portion 8 into fifth inflow hole 32*e*, can pass from fifth inflow hole connecting area 44*e* through fifth inflow hole 32*e* and down into the reverse side area (lower area) 33 of grate 32. Sixth inflow hole 32*f* is formed so that flush water flowing into sixth inflow hole connecting area 44*f*, which is the area around the entrance from bowl portion 8 into sixth inflow hole 32*f*, can pass from sixth inflow hole connecting area 44*f* through sixth inflow hole 32*f* and down into the reverse side area (lower area) 33 of grate 32.

The sizes of first inflow hole 32*a* through sixth inflow hole 32*f* are formed to be inversely proportional to the size of the flush water flow volume flowing into each of first inflow hole connecting area 44*a* through sixth inflow hole connecting area 44*f*, which are the areas in the vicinity of the entrance to each of the inflow holes from bowl portion 8. By adjusting the flush water amount using inflow holes formed on the top surface of grate 32, a simple and more accurate adjustment can be made than when adjusting the amount of flush water by adjusting only the size of gap inflow opening G. In general, flow speed is increased in areas with a high flush water flow volume.

In a urinal 1 of the present embodiment, in the vicinity of grate 32 at the bottom portion of bowl portion 8 the flow volume of flush water flowing down from the rear side, the left rear side, and the right rear side of bowl portion 8 toward grate 32 is formed to be comparatively larger than the flow volume of flush water flowing down from the front side and left front side of bowl portion 8 toward grate 32, but in another urinal embodiment, in the vicinity of the grate at the bottom portion of the bowl portion, the flow volume of flush water flowing down from the rear side and left rear and right rear sides of the bowl portion toward the grate may also be formed to be relatively smaller than the flow volume of flush water flowing down from the front side and left front and right sides of the bowl portion toward the grate. In this case, each inflow hole (and the size of the flow path surface area, including each inflow hole) is formed in a size inversely proportional to the size of the flush water flow volume flowing into each inflow hole connecting area. I.e., at this point, for example, the opening surface area of the inflow hole or holes at the front side of grate 32 bowl portion 8 (e.g., each of the inflow hole portions of the type corresponding to the positions of third inflow hole front side portion 32*h*, fourth inflow hole 32*d*, and fifth inflow hole front side portion 32*i*) is formed to be smaller in opening surface area than the grate 32 bowl portion 8 back side inflow hole (e.g., each of the inflow hole portions of the type corresponding to the positions of first inflow hole 32*a*, second inflow hole 32*b*, second inflow hole 32*b*, third inflow hole deep interior side portion 32*g*, fifth inflow hole deep interior side portion 32*j*, and sixth inflow hole 32*f*). Furthermore, at this point, for example, the surface area of the flow path on the front side of grate 32 bowl portion 8 (e.g., the inflow openings of the type corresponding to the positions of third inflow hole front side portion 32*h*, fourth inflow hole 32*d*, fifth inflow hole front side portion 32*i*, and rear gap inflow opening GR) is formed to be smaller than the surface area of the flow path at the rear side of grate 32 bowl portion 8 (e.g., each of the inflow hole portions of the type corresponding to the positions of first inflow hole 32*a*, second inflow hole 32*b*, second inflow hole 32*b*, third inflow hole deep interior side portion 32*g*, fifth inflow hole deep interior side portion 32*j*, sixth inflow hole 32*f*, and front gap inflow opening GF).

Moreover, in a urinal of another embodiment, even when the flow volumes of flush water flowing down toward the grate differ in flow volume and proportion depending on direction, the same effect as the present embodiment can be provided by adjusting the position and size of each inflow hole in the grate.

In the present embodiment the flow volume of flush water flowing into first inflow hole connecting area 44*a* from the rear side of bowl portion 8 as shown by arrow F1 is comparatively large, so the size (inflow hole opening surface area) of first inflow hole 32*a* is formed to be comparatively small. Thus, the flow volume of the flow of flush water flowing down the reverse side area 33 on grate 32 (the interior area of discharge opening portion 10) shown by arrow F7 becomes comparatively small, and the flow volume and flow speed of the flush water flow flowing into discharge opening 34 shown by arrow F8 is essentially the same as the flow volume and flow speed of the flush water flow flowing into discharge opening 34 from other directions, as described below.

Similarly, the flow volume of the flow of flush water flowing into second inflow hole connecting area 44*b* from the right rear side of bowl portion 8 shown by arrow F2 and the flow volume of the flow of flush water flowing into sixth inflow hole connecting area 44*f* from the left rear side of bowl portion 8 shown by arrow F6, are comparatively large, so the size of second inflow hole 32*b* and sixth inflow hole 32*f* (the inflow hole opening surface area) are formed to be comparatively small. Thus the flow volume of the flow of flush water flowing down the reverse side area 33 on grate 32 (the interior area of discharge opening portion 10) becomes comparatively small, and the flow volume and flow speed of the flush water flow flowing into discharge opening 34 from second inflow hole 32*b* and sixth inflow hole 32*f* such, as shown by arrows F9 and F13, is essentially the same as the flow volume and flow speed of the flush water flow flowing into discharge opening 34 from other directions, as described below.

Similarly, the flow volume of the flow of flush water flowing into third inflow hole connecting area 44*c* from the right front side of bowl portion 8, shown by arrow F3, and the flow volume of the flow of flush water flowing into fifth inflow hole connecting area 44*e* from the right front side of bowl portion 8, shown by arrow F5, are comparatively small, therefore the size (opening surface area of the inflow hole) of third inflow hole 32*c* and fifth inflow hole 32*e* is made comparatively large. Thus the flow volume of the flow of flush water flowing down the reverse side area 33 on grate 32 (the interior area of discharge opening portion 10) becomes comparatively large, and the flow volume and flow speed of the flush water flow flowing into discharge opening 34 from third inflow hole 32*c* and fifth inflow hole 32*e* such, as shown by arrows F10 and F12, is essentially the same as the flow volume and flow speed of the flush water flow flowing into discharge opening 34 from other directions, as described below.

Similarly, the flow volume of the flow of flush water flowing into fourth inflow hole connecting area 44*d* from the front side of bowl portion 8 of the type shown by arrow F4 is comparatively small, so the size (inflow hole opening surface area) of fourth inflow hole 32*d* is formed to be comparatively large. Thus the flow volume of the flush water flow flowing down the back area 33 on grate 32 (the interior area of discharge opening portion 10) becomes comparatively large, and the flow volume and flow speed of the flush water flow flowing into discharge opening 34 from fourth inflow hole 32*d*, as shown by arrow F11, is essentially the same as the flow volume and flow speed of the flush water flow flowing into discharge opening 34 from other directions, as described below.

As described above, first inflow hole 32*a*, second inflow hole 32*b*, and sixth inflow hole 32*f* form a relatively small sized opening (opening surface area), and third inflow hole 32*c*, fourth inflow hole 32*d*, and fifth inflow hole 32*e* form a relatively large sized opening (opening surface area).

If grate 32 is divided between a front area and a back area using center line C2 as a boundary; first inflow hole 32*a*, second inflow hole 32*b*, third inflow hole deep interior side portion 32*g*, fifth inflow hole deep interior side portion 32*j*, and sixth inflow hole 32*f* are positioned in the back area; and third inflow hole front side portion 32*h*, fourth inflow hole 32*d*, and fifth inflow hole front side portion 32*i* are positioned in the front area.

Here the total opening surface area of first inflow hole 32*a*, second inflow hole 32*b*, third inflow hole deep interior side portion 32*g*, fifth inflow hole deep interior side portion 32*j*, and sixth inflow hole 32*f* positioned in the back area is formed to be smaller than the total opening surface area of third inflow hole front side portion 32*h*, fourth inflow hole 32*d*, and fifth inflow hole front side portion 32*i* positioned in the front area.

In cases where grate 32 is positioned on bowl portion 8, a relatively small gap inflow opening G is formed over essentially the entire perimeter between resin grate 32 and porcelain bowl portion 8. In this embodiment, a relatively small amount of flush water is flowing down from bowl portion 8 through gap inflow opening G to the reverse side area 33 (interior of discharge opening portion 10) of grate 32. The amount of flush water flowing into reverse side area 33 of grate 32 from gap inflow opening G is less than the amount of flush water flowing into reverse side area 33 of grate 32 from each of the above-described inflow holes. Therefore in the present embodiment, of the total amount of flush water flowing into reverse side area 33, the flow volume of flush water flowing into reverse side area 33 of grate 32 from each of the above-described inflow holes is primary, and the flow volume of flush water flowing into reverse side area 33 of grate 32 from gap inflow opening G is secondary.

Flush water which has flowed into discharge opening portion 10 through gap inflow opening G from the outer perimeter of grate 32 merges with the flow of flush water flowing into discharge opening 34 from each of the directions shown by arrows F8 through F13. Such merged flush water also forms a flow which causes the flow volume and flow speed of flush water flowing into discharge opening 34 to be essentially uniform in all directions.

In the present embodiment gap inflow opening G forms an essentially uniformly sized gap over the entire perimeter.

Note that gap inflow opening G also functions as an opening for causing flush water to flow down from the bowl portion 8 side into grate 32 reverse side area 33 (the interior of discharge opening portion 10), therefore as a variant example, by forming the gap inflow opening G in a large size in one part, gap inflow opening G can also be used as an opening to perform the same function as each of the above-described inflow holes.

When considering gap inflow opening G, if gap inflow opening G is defined by division into a front gap inflow opening GF and a rear gap inflow opening GR using center line C2 as a boundary, the sum of the flow path surface area of first inflow hole 32*a*, second inflow hole 32*b*, third inflow hole deep interior side portion 32*g*, fifth inflow hole deep interior side portion 32*j*, sixth inflow hole 32*f*, and rear gap inflow opening GR defined by grate 32 in the rear area is formed to be smaller than the sum of the flow path surface area of the third inflow hole front side portion 32*h*, fourth inflow hole 32*d*, fifth inflow hole front side portion 32*i*, and front gap inflow opening GF defined by the grate 32 in the front area.

Thus flush water which has passed through each of the inflow holes 32*a* through 32*f*, which are formed asymmetrically in the front-to-back direction relative to the center of grate 32, flows in at the grate 32 reverse side area 33 (interior of discharge opening portion 10) in a flow which, relative to the essentially circular discharge opening 34, is symmetrical with respect to center axis line C, and has an essentially uniform flow speed distribution.

Note that as a variant example the flow path surface area may also be calculated by not forming inflow holes on the top surface of the grate, but rather using the gap inflow openings formed between the grate and bowl portion 8 as the flow paths. For example, the gap inflow opening could be defined by a division around the center line into a front gap inflow opening in the front area and a back gap inflow opening in the back area. Note that the gap inflow opening may also be formed by dividing into two or more inflow openings.

The front gap inflow opening is formed so that the flush water flowing from bowl portion 8 into the front gap inflow opening can pass through the front gap inflow opening down to the reverse side area (lower area) of the grate. The back gap inflow opening is formed so that the flush water flowing from bowl portion 8 into the back gap inflow opening can pass through the back gap inflow opening down to the reverse side area (lower area) of the grate.

The size of each gap inflow opening is formed to be inversely proportional to the size of the flow volume of flush water flowing into each gap inflow opening from bowl portion 8.

A variant embodiment of urinal 1 is formed so that close to the grate at the bottom portion of bowl portion 8, the amount of flush water flowing down toward the grate from the rear side, left rear side, and right rear side of bowl portion 8 is relatively larger than the amount of flush water flowing down toward the grate from the front side, left front side, and right front side of bowl portion 8.

In a variant embodiment, the amount of the flush water flowing into the rear side gap inflow opening from the rear side of bowl portion 8 is relatively large, therefore the size of the rear side gap inflow opening is formed to be relatively small. Thus the flow volume of flush water flowing down to the reverse side area (interior of the discharge opening portion) of the grate is relatively small, and flow volume and flow speed of flush water flowing into discharge opening 34 is essentially the same as the flow volume and flow speed of flush water flowing into discharge opening 34 from the front direction, as described below.

Similarly, the flow volume of flush water flowing into the front side gap inflow opening from the front side of bowl portion 8 is relatively small, therefore the size of the front side gap inflow opening is formed to be relatively large. Thus the flow volume of the flush water flowing down into the reverse side area (interior of the discharge opening portion) is relatively large, and the flow volume and flow speed of flush water flowing into discharge opening 34 from the front side gap inflow opening is essentially the same as the flow volume and flow speed of flush water flowing into discharge opening 34 from the rear direction.

Note that grate 32 of urinal 1 according to an embodiment of the present invention is not limited to the above-described grate 32, but may also be a grate of the type used conventionally in urinals, e.g., a grate not having the object of adjusting the flow volume of flush water flowing down into the reverse side area of the grate. Moreover, grate 32 may have not only a shape whereby inflow holes are formed on the top surface of the grate, but also a shape whereby no inflow holes are formed in the top surface of the grate.

Next, referring to FIGS. 1 through 3, we explain the action (operation) according to an embodiment of the present invention.

Normally when a user stands in front of a urinal 1 a body sensor 28 detects the presence of the user and sends detection information to a control unit 30, and the control unit 30 recognizes the presence of the user. In a standby state prior to urination by the user, primarily flush water is present within discharge trap 12 as pooled water W.

When a user urinates into urinal 1 bowl portion 8, urine flows into discharge trap 12 from the bottom portion of bowl portion 8 and the majority of the originally present pooled water W is discharged (substituted) by the inflowing urine; a urine-water mixed liquid with an extremely high urine concentration is then present as a new pooled water W in discharge trap 12.

When a user completes urination into urinal 1 bowl portion 8, and the user who has finished urinating moves away from the urinal 1, the body sensor 28 changes to a state of not detecting a user's presence. When body sensor 28 goes into a non-detection state, control unit 30 recognizes that the user has left urinal 1, and starts the urinal flushing operation.

Control unit 30 sends a control signal to on/off valve 24 opening on/off valve 24 and causing the spouting of a predetermined amount of flush water from spreader 26 into bowl portion 8. The amount of spouted flush water is set to an essentially fixed flow volume per unit time. This flush water flows down bowl portion 8 and reaches discharge opening portion 10.

Flush water spouted from spreader 26 flows down bowl portion 8 as it spreads out.

Flush water which has flowed down bowl portion 8 as it spreads reaches discharge opening portion 10 grate 32 from all directions on the bowl surface of bowl portion 8, as shown by arrows F1 through F6. In the present embodiment, the flow volume of flush water shown by arrows F1, F2, and F6 is greater than the flow volume of flush water shown by arrows F3, F4, and F5.

The relatively large flow volume of flush water flowing into first inflow hole connecting area 44*a* shown by arrow F1 primarily passes through first inflow hole 32*a* and flows down into the reverse side area 33 of grate 32 (the inside area of discharge opening portion 10); the flow volume of flush water passing through first inflow hole 32*a* is adjusted to be relatively small, forming a flush water flow which primarily flows into discharge opening 34, as shown by arrow F8.

The relatively large flow volume of flush water flowing into second inflow hole connecting area 44*b* shown by arrow F2 primarily passes through second inflow hole 32*b* and flows down into the reverse side area 33 of grate 32 (the inside area of discharge opening portion 10); the flow volume of flush water passing through second inflow hole 32*b* is adjusted to be relatively small, forming a flush water flow which primarily flows into discharge opening 34, as shown by arrow F9.

The relatively small flow volume of flush water flowing into third inflow hole connecting area 44*c* shown by arrow F3 primarily passes through third inflow hole 32*c* and flows down into the reverse side area 33 of grate 32 (the inside area of discharge opening portion 10); the flow volume of flush water passing through third inflow hole 32*c* is adjusted to be relatively large, forming a flush water flow which primarily flows into discharge opening 34, as shown by arrow F10.

The relatively small flow volume of flush water flowing into fourth inflow hole connecting area 44*d* shown by arrow F4 primarily passes through fourth inflow hole 32*d* and flows down into the reverse side area 33 of grate 32 (the inside area of discharge opening portion 10); the flow volume of flush water passing through fourth inflow hole 32*d* is adjusted to be relatively large, forming a flush water flow which primarily flows into discharge opening 34, as shown by arrow F11.

The relatively small flow volume of flush water flowing into fifth inflow hole connecting area 44*e* shown by arrow F5 primarily passes through fifth inflow hole 32*e* and flows down into the reverse side area 33 of grate 32 (the inside area of discharge opening portion 10); the flow volume of flush water passing through fifth inflow hole 32*e* is adjusted to be relatively large, forming a flush water flow which primarily flows into discharge opening 34, as shown by arrow F12.

The relatively large flow volume of flush water flowing into sixth inflow hole connecting area 44*f* shown by arrow F6 primarily passes through sixth inflow hole 32*f* and flows down into the reverse side area 33 of grate 32 (the inside area of discharge opening portion 10); the flow volume of flush water passing through sixth inflow hole 32*f* is adjusted to be relatively small, forming a flush water flow which primarily flows into discharge opening 34, as shown by arrow F13.

Thus the amounts of flush water flowing into discharge opening 34 shown by arrows F8 through F13 are adjusted to be essentially the same flush water amounts.

The flows of flush water flowing into discharge opening 34 as shown by arrows F8 through F13 are formed to be symmetrical relative to the center axis line C of discharge opening 34. The flows of flush water shown by arrows F8 through F13 have essentially the same flow volume and flow speed in each flow, and form an essentially uniform flow speed distribution centered on center axis line C of discharge opening 34.

Therefore flush water flows from all directions in an essentially uniform flow volume and flow speed into discharge opening 34.

In descending pipe 36, as shown by arrows F8 through F13, flush water flows as essentially uniform flow volume flows from all directions relative to discharge opening 34.

Also, the descending pipe front wall 36*a* of descending pipe 36 and the shared wall 38 are formed to be symmetrical relative to center axis line C of descending pipe 36, therefore the flows of flush water flowing down within descending pipe 36 flow down in symmetrical flows, flow volumes, and flow speeds relative to center axis line C.

Hence flush water forms a flow which flows downward in an essentially uniform manner in the front-to-back and left-to-right directions, as shown by arrow F14. Therefore flush water is able to flow smoothly without creating stagnations of flow in descending pipe 36. Hence flush water flowing into ascending pipe 40 through horizontal pipe 42 is more easily able to form relatively uniform flows in the front-to-back and left-to-right directions.

As a result, flush water flowing into the horizontal pipe exit 42*d* of horizontal pipe 42 also forms flows which inflow downward in an essentially uniform manner in the front-to-back and left-to-right directions. Of the flush water flowing into horizontal pipe 42, the flush water on the top side of horizontal pipe 42, i.e., the flush water flowing in the part close to return flow path-forming portion 38*a*, flows at a relatively acute angle and over a short distance so as make a return around return flow path-forming portion 38*a*, as shown by arrow F15, thus becoming relatively greatly decelerated in flow speed.

In contrast, of the flush water flowing into horizontal pipe 42, the flush water flowing into the bottom portion side (the lower portion side) of horizontal pipe 42, i.e., the part close to the bottom portion 42*a* of horizontal pipe 42 (e.g., the part on the lower half side in the up-down direction of horizontal pipe 42) flows smoothly along the arcuate curve extending to the bottom portion 42*a* of horizontal pipe 42 from the exit-side arcuate portion 36*d* of descending pipe 36, as shown by arrow F16, and a relatively fast flow speed is maintained. In an embodiment of the present invention, this relatively slow speed flush water collides with the resistance portion 42*b* formed by flat portion 42*e*, and the flow speed is relatively greatly reduced.

If, unlike the invention, no resistance portion 42*b* is built onto horizontal pipe 42 bottom portion 42*a*, flush water flowing into the part close to horizontal pipe 42 bottom portion 42*a* is slowed in flow speed by resistance portion 42*b*, therefore a relatively fast flow speed is maintained. At this point a relatively large flow speed differential arises between the flow speed of flush water flowing in the top portion side of horizontal pipe 42 and the flush water flowing in the lower portion side thereof. Thus if a flow speed differential arises between the flush water in the upper part and lower part of horizontal pipe 42, then when flush water flows from horizontal pipe 42 into ascending pipe 40, a flow speed differential arises between the flow speed of flush water flowing in the vicinity of return flow path-forming portion 38*a* in ascending pipe 40 entrance portion 40*f* and the flow speed of the flush water flowing in the vicinity of ascending pipe rear wall 40*b* at entrance portion 40*f*, causing stagnation of flush water inside ascending pipe 40, as described below.

In an embodiment of the present invention, portions on the lower side of flush water flow F16, which flow into horizontal pipe 42 along a gradual bend extending from the exit-side arcuate portion 36*d* of descending pipe 36 to the bottom portion 42*a* of horizontal pipe 42, and of flush water flow F17 flowing down from the top of descending pipe 36 and into horizontal pipe 42, collide with resistance portion 42*b*, and the flow speed of flush water passing through the vicinity of bottom portion 42*a* is relatively greatly reduced. Therefore the flow speed differential between the flow speed of flush water flowing on the top portion side of horizontal pipe 42 and the flow speed of flush water flowing on the bottom portion side thereof is slowed by a relatively small amount. Therefore the occurrence of a flow speed differential between the flow speed of the flush water flow F15 near the return flow path-forming portion 38*a* of ascending pipe 40 entrance portion 40*f* and the flow speed of flush water flow F18 near ascending pipe rear wall 40*b* of the entrance portion 40*f* thereof when flush water flows from horizontal pipe 42 into ascending pipe 40 can be suppressed.

In this embodiment of the invention, horizontal pipe 42 flat portion 42*e* is formed to extend in a straight line essentially horizontal manner in the front-to-back direction, therefore the flat portion 42*e* along the direction of flush water flow can efficiently slow the flow speed of flush water.

In the embodiment of the invention, horizontal pipe 42 flat portion 42*e* is formed up to a position further upstream (front side of the urinal) than a position vertically below shared wall 38 return flow path-forming portion 38*a*, and of the flush water flowing down from descending pipe 36, the part flowing in to the vicinity of bottom portion 42*a* more easily collides due to flat portion 42*e*, so that the flow speed in the vicinity of bottom portion 42*a* is relatively greatly reduced.

Furthermore, because of the fact that horizontal pipe 42 flat portion 42*e* is also formed in the left-right direction at a position further upstream (on the front side of the urinal) of a position vertically below shared wall 38 return flow path-forming portion 38*a*, the flow speed deceleration effect is relatively great when flush water collides with flat portion 42*e*, and the flow speed close to bottom portion 42*a* is relatively greatly decelerated.

In the invention thus constituted, furthermore, in cases where the flush water bends from horizontal pipe 42 to ascending pipe 40, the flow speed of the flow on the outer perimeter side flowing in the vicinity of ascending pipe 40 entrance-side arcuate portion 40*e* has a tendency to become greater than the flow speed on the inner perimeter side of return flow path-forming portion 38*a*, in which the flow path sharply bends.

It is expected that this type of flow speed differential will be reduced or eliminated by horizontal pipe 42 resistance portion 42*b* or the like as described above, but note that when flush water flows from horizontal pipe 42 into ascending pipe 40, there is a possibility that a flow speed differential will arise between the flow speed of flush water flow F15 in the vicinity of return flow path-forming portion 38*a* at the entrance portion 40*f* of ascending pipe 40 and the flow speed of flush water flow F18 in the vicinity of the ascending pipe rear wall 40*b* of the entrance portion 40*f* thereof.

If, unlike the present invention, the flow speed differential between the flow speed of the flush water flow on the front side of ascending pipe 40 and the flow speed of the flush water flow on the rear side thereof becomes large, for example if the flow speed differential between the flow speed of the flush water flow at the front side flowing into entrance portion 40*f* and the flush water flow at the rear side flowing into entrance portion 40*f* becomes large or, for example, the flow speed differential between the flow speed of the flush water on the front side and the flow speed of the flush water on the rear side is increased during the rise side in ascending pipe 40, an imbalance in the flow of flush water in ascending pipe 40 and distortion of flow speed distributions can occur, more easily leading to a flow stagnation. If, hypothetically, stagnation occurs in the flow, then in the vicinity of return flow path-forming portion 38*a*, for example, as shown by dotted line arrow f, a flow stagnation caused by a swirling flow occurs, and since this impedes follow-on flow, a drop in the pooled water substitution rate is induced.

In contrast, in the embodiment of the present invention, as described above, the flow speed differential between the flow speed of flush water flow F15 at the front side flowing into entrance portion 40*f* and the flow speed of flush water flow F18 at the rear side flowing into entrance portion 40*f* is suppressed by the resistance portion 42*b* on horizontal pipe 42.

Next, in the present embodiment of the invention, as noted below, we explain the suppression of an increase in the flow speed differential between the flow speed of the flush water flow F19 at the front side and the flow speed of the flush water flow F20 at the rear side.

In an embodiment of the present invention, ascending pipe 40 is formed so that its cross sectional surface area is fixed from entrance portion 40*f* to exit portion 40*g*, therefore flush water can flow from entrance portion 40*f* to exit portion 40*g* while essentially maintaining a fixed flow speed distribution state. I.e., in ascending pipe 40, the flow speed differential already held by the flush water flowing into entrance portion 40*f* is suppressed from being further increased, and flush water can flow to exit portion 40*g* with the already present flow speed differential in a maintained state.

In the present embodiment of the invention, ascending pipe 40 is formed so that its cross sectional surface area is fixed from entrance portion 40*f* to exit portion 40*g*, and the flow path shape is fixed from entrance portion 40*f* to exit portion 40*g*. Thus when the cross sectional surface area of the flow path is fixed, the direction and flow speed magnitude of flush water in entrance portion 40*f* is more resistant to turbulence, and more easily maintained up to exit portion 40*g*. If, hypothetically, the cross sectional surface area increases or decreases in exit portion 40*g*, there is a tendency for the problem of changing flush water flow direction and flow speed to occur in response to changes in the flow path.

In the present embodiment of the invention, ascending pipe 40, shared wall 38, and ascending pipe rear wall 40*b* are formed to have parallel wall surfaces in the front-to-back direction, and to have the same slopes and slope angles, so flow F19 along shared wall 38 and flow F20 along ascending pipe rear wall 40*b* form relatively parallel rising flows in the front-to-back direction. In addition, the distance between shared wall 38 and ascending pipe rear wall 40*b* is also formed to be fixed from entrance portion 40*f* to exit portion 40*g* of ascending pipe 40, therefore it is difficult for the flows along each wall surface to be made turbulent, and flow can be achieved without inter-flow interference or stagnation.

Moreover, ascending pipe 40 is formed so that ascending pipe left side wall 40*c* and ascending pipe right side wall 40*d*, which constitute its left and right walls respectively, are parallel; therefore flush water is more easily able to form a relatively parallel rising flow in the left-right direction between the flow along ascending pipe left side wall 40*c* and the flow along ascending pipe right side wall 40*d*.

Thus flush water in ascending pipe 40, where flush water flow stagnation occurs relatively easily, flows smoothly, without stagnation of the flush water flow. Therefore a liquid comprising an extremely high urine concentration mixture of urine and water inside discharge trap 12 is discharged so as to be efficiently substituted (so as to be replaced) by flush water newly flowing into discharge trap 12. As a result, even when the flush water amount is reduced, the extremely high urine concentration liquid in discharge trap 12 can be efficiently substituted with a relatively low amount of flush water, and the pooled water W substitution rate can be improved. This substitution rate indicates as a percentage roughly what proportion of the total amount of flush water which had accumulated in discharge trap 12 as pooled water W is substituted by flush water newly inflowing to discharge trap 12 in a single flush operation, and what proportion remains in new pooled water W.

Flush water flowing out from ascending pipe 40 flows into connecting portion 18, and is discharged from connecting portion 18 through discharge socket 14 into discharge plumbing 16.

When spouting of water from spreader 26 is continued for a certain time period, control unit 30 closes on/off valve 24 and ends water spouting from spreader 26. The series of flushing operations in urinal 1 is thus completed.

Immediately after this series of flushing operations is completed in urinal 1, what is present in discharge trap 12 as pooled water W is primarily flush water. As described above, the improvement in the pooled water substitution rate means that because the discharge trap 12 is in a state whereby after completion of each sequence of flushing operations in urinal 1 the concentration of urine remaining in pooled water W within discharge trap 12 is reduced to a certain base level or below (a state in which newly spouted flush water is primarily present as pooled water W), the depositing (occurrence) of uric scale in discharge trap 12 by the urine component remaining in pooled water W can be suppressed.

Next we explain the operational effect of urinal 1 according to the above-described embodiment of the invention.

Using a urinal 1 according to the above-described embodiment of the present invention, the top portion of horizontal pipe 42 is formed by the shared wall return flow path-forming portion 38*a*, and a resistance portion 42*b* for slowing the flow speed of flush water flowing in the vicinity of bottom portion 42*a* is formed on the horizontal pipe 42 bottom portion 42*a* opposite this return flow path-forming portion 38*a*, therefore the flow speed of flush water flowing in the vicinity of bottom portion 42*a* is reduced by resistance portion 42*b*.

As a result, the differential between the flow rate of flush water flowing in the vicinity of return flow path-forming portion 38*a* at the top portion of horizontal pipe 42, and the flow rate of flush water flowing in the vicinity of the bottom portion 42*a* on the bottom portion 42*a* side of horizontal pipe 42 can be suppressed.

Therefore in ascending pipe 40 connected to the downstream side of horizontal pipe 42, the difference can be suppressed between the flow speed of flush water flowing into primarily the front side of ascending pipe 40 from the vicinity of return flow path-forming portion 38*a*, and the flow speed of flush water flowing into primarily the rear side of ascending pipe 40 from the vicinity of bottom portion 42*a* of horizontal pipe 42.

Therefore flow speed differentials in flush water flowing into ascending pipe 40 can be suppressed, as can the occurrence of stagnated flow of flush water in ascending pipe 40. By so doing, the substitution rate for pooled water into which urine is mixed in discharge trap 12 can be improved, and residual urine in the post-flush pooled water can be reduced, thereby reducing the occurrence of uric scale.

In a urinal 1 according to the present embodiment of the invention, resistance portion 42*b* is formed further upstream than a position vertically below return flow path-forming portion 38*a* on the bottom end of shared wall 38, therefore of the flush water flowing down descending pipe 36, the part primarily flowing in the vicinity of bottom portion 42*a* of horizontal pipe 42 collides with the resistance portion 42*b* formed at the bottom portion 42*a* of horizontal pipe 42 so that its flow speed is more easily reduced.

Therefore the flow rate of flush water flowing near the bottom portion 42*a* of horizontal pipe 42 can be further reduced using the resistance portion 42*b* formed in the bottom portion 42*a* of horizontal pipe 42.

Using a urinal 1 according to the present embodiment of the invention, the bottom surface of discharge trap 12 has, in addition to resistance portion 42*b*, an exit-side arcuate portion 36*d* and entrance-side arcuate portion 40*e* for smoothly introducing flush water, and can therefore reduce the flow speed of flush water flowing in the vicinity of horizontal pipe 42 bottom portion 42*a*, and smoothly effect the flow of flush water inside discharge trap 12.

Using a urinal 1 according to the present embodiment of the invention, the flow speed of flush water flowing in the vicinity of horizontal pipe 42 bottom portion 42*a* can be slowed by the flat portion 42*e* formed by the bottom portion 42*a* of horizontal pipe 42. Therefore through use of a relatively simple structure, flow speed differentials in flush water flowing into ascending pipe 40 can be suppressed, as can the occurrence of stagnated flow of flush water in ascending pipe 40.

Using a urinal 1 according to the present embodiment of the invention, the flow speed of flush water flowing in the vicinity of horizontal pipe 42 bottom portion 42*a* can be slowed by the corrugated portion (concave and/or convex portion) formed by the bottom portion 42*a* of horizontal pipe 42. Therefore through use of a relatively simple structure, flow speed differentials in flush water flowing into ascending pipe 40 can be suppressed, as can the occurrence of stagnated flow of flush water in ascending pipe 40.

Using a urinal 1 according to the present embodiment of the invention, the flow speed of flush water flowing in the vicinity of horizontal pipe 42 bottom portion 42*a* can be slowed by the projecting portion protruding from bottom portion 42*a* of horizontal pipe 42. Therefore through use of a relatively simple structure, flow speed differentials in flush water flowing into ascending pipe 40 can be suppressed, as can the occurrence of stagnated flow of flush water in ascending pipe 40.

What is claimed is:

1. A urinal in which a bowl portion is flushed with flush water, comprising:

a front-facing bowl portion defining with a discharge opening at a bottom of the bowl portion;

a single discharge trap into which flush water which has passed through the discharge opening flows, for accumulating flush water and forming a water seal; and a connecting portion for connecting the discharge trap with a discharge plumbing connected on a downstream side of the discharge trap;

whereby the single discharge trap includes— a descending pipe extending downward from the discharge opening of the bowl portion, and an ascending pipe formed on the rear side of the descending pipe and extending upward, whereby a rear wall of the descending pipe and a front wall of the ascending pipe are formed by a shared wall, wherein the front wall of the descending pipe is inclined rearward from an upstream end of the front wall to a downstream end of the front wall, and the rear wall of the descending pipe is formed by the shared wall and is inclined forward from an upstream end of the rear wall to a downstream end of the rear wall, wherein the descending pipe is tapered from an upstream end of the descending pipe to a downstream end of the descending pipe, whereas the ascending pipe has an essentially constant cross-section from an upstream end of the ascending pipe to a downstream end of the ascending pipe, and the ascending pipe is inclined rearward from the upstream end of the ascending pipe to the downstream end of the ascending pipe, and an inclined angle of the rear wall of the ascending pipe is the essentially same as an inclined angle of the shared wall, and wherein the single discharge trap further includes a horizontal pipe connecting the downstream end of the descending pipe and the upstream end of the ascending pipe, whereby a top portion of the horizontal pipe is formed by a return flow path-forming portion at a bottom end of the shared wall, and a bottom portion of the horizontal pipe having a resistance portion for reducing a flow speed of flush water flowing thereover, wherein the resistance portion is an approximately flat planar surface extending from front to rear and from left to right within the horizontal pipe, wherein nothing is placed on the approximately flat planar surface, wherein the horizontal pipe forms a pipe shape from the downstream end of the descending pipe to the upstream end of the ascending pipe and a bottom surface of the pipe shape forms the approximately flat planar surface.

2. The urinal of claim 1, wherein the resistance portion of the horizontal pipe of the discharge trap extends from a further upstream position than a position vertically below the return flow path-forming portion at the bottom end of the shared wall toward the position vertically below the return flow path-forming portion.

3. The urinal of claim 2, wherein the bottom portion of the horizontal pipe forms a first arcuate portion at an upstream side of the resistance portion, and a second arcuate portion formed on a downstream side of the resistance portion.

4. A urinal in which a bowl portion is flushed with flush water, comprising:

a front-facing bowl portion defining a discharge opening at a bottom of the bowl portion;

a discharge trap into which flush water which has passed through the discharge opening flows, for accumulating flush water and forming a water seal; and a connecting portion for connecting the discharge trap with a discharge plumbing connected on a downstream side of the discharge trap;

whereby the discharge trap includes— a descending pipe extending downward from the discharge opening of the bowl portion, and an ascending pipe extending upward, whereby a rear wall of the descending pipe and a front wall of the ascending pipe are formed by a shared wall, and wherein the discharge trap further includes— a horizontal pipe connecting a downstream end of the descending pipe and an upstream end of the ascending pipe, whereby a top portion of the horizontal pipe is formed by a return flow path-forming portion at a bottom end of the shared wall, and a resistance portion for reducing a flow speed of flush water flowing on a bottom portion of the horizontal pipe is formed at the bottom portion, wherein the resistance portion of the horizontal pipe of the discharge trap is a corrugated portion formed on the bottom portion vertically below the bottom of the shared wall, the corrugated portion is formed from an upstream position toward a position vertically below a front end of the return flow path-forming portion.

5. A urinal in which a bowl portion is flushed with flush water, comprising:

the bowl portion defining a discharge opening at a bottom of the bowl portion;

a discharge trap into which flush water which has passed through the discharge opening flows, for accumulating flush water and forming a water seal; and a connecting portion for connecting the discharge trap with a discharge connected on a downstream side of the discharge trap;

whereby the discharge trap includes— a descending pipe extending downward from the discharge opening of the bowl portion, and an ascending pipe extending upward, whereby a rear wall of the descending pipe and a front wall of the ascending pipe are formed by a shared wall, and wherein the discharge trap further includes—a horizontal pipe connecting a downstream end of the descending pipe and an upstream end of the ascending pipe, whereby the top portion of the horizontal pipe is formed by a return flow path-forming portion at a bottom end of the shared wall, and a resistance portion for reducing a flow speed of flush water flowing on a bottom portion of the horizontal pipe is formed at the bottom portion, wherein the resistance portion of the horizontal pipe of the discharge trap is a projecting portion protruding from the bottom portion vertically below the bottom of the shared wall, wherein the projecting portion is formed from an upstream position toward a position vertically below a front end of the return flow path-forming portion.

6. The urinal of claim 1, wherein the resistance portion of the horizontal pipe of the discharge trap extends beneath a vertical projection of the bottom of the shared wall, defining an upstream resistance portion length which is greater than a downstream resistance portion length.

7. The urinal of claim 4, wherein the resistance portion of the horizontal pipe of the discharge trap extends beneath a vertical projection of the bottom of the shared wall, defining an upstream resistance portion length which is greater than a downstream resistance portion length.

8. The urinal of claim 5, wherein the resistance portion of the horizontal pipe of the discharge trap extends beneath a vertical projection of the bottom of the shared wall, defining an upstream resistance portion length which is greater than a downstream resistance portion length.

9. The urinal of claim 4, wherein the resistance portion of the horizontal pipe of the discharge trap extends from a further upstream position than a position vertically below the return flow path-forming portion at the bottom end of the shared wall toward the position vertically below the return flow path-forming portion.

10. The urinal of claim 9, wherein the bottom portion of the horizontal pipe forms a first arcuate portion at an upstream side of the resistance portion, and a second arcuate portion formed on a downstream side of the resistance portion.

11. The urinal of claim 5, wherein the resistance portion of the horizontal pipe of the discharge trap extends from a further upstream position than a position vertically below the return flow path-forming portion at the bottom end of the shared wall toward the position vertically below the return flow path-forming portion.

12. The urinal of claim 11, wherein the bottom portion of the horizontal pipe forms a first arcuate portion at an upstream side of the resistance portion, and a second arcuate portion formed on a downstream side of the resistance portion.

* * * * *